United States Patent [19]

Donahue et al.

[11] Patent Number: 4,516,655

[45] Date of Patent: May 14, 1985

[54] REMOTE DRIVE WITH POWERSHIFT TRANSMISSION

[75] Inventors: John M. Donahue, Strasburg; Michael J. Gagner, New Philadelphia, both of Ohio

[73] Assignee: The Gradall Company, New Philadelphia, Ohio

[21] Appl. No.: 522,921

[22] Filed: Aug. 12, 1983

[51] Int. Cl.[3] ..... E02F 3/00

[52] U.S. Cl. ..... 180/321; 37/DIG. 17; 74/661; 414/687

[58] Field of Search ..... 180/321, 323; 414/718, 414/687; 74/661; 37/DIG. 1, DIG. 17

[56] References Cited

U.S. PATENT DOCUMENTS

| | | | |
|---|---|---|---|
| Re. 31,500 | 1/1984 | Brownfield | 180/321 |
| 2,981,012 | 4/1961 | Meyer | 37/DIG. 17 |
| 3,212,356 | 10/1965 | Davis | 74/661 |

*Primary Examiner*—Richard A. Bertsch
*Attorney, Agent, or Firm*—Robert D. Yeager

[57] ABSTRACT

A remote driving system (40) for use on a material handling vehicle (10) having a rotatable upper structure (12) including means for driving said material handling vehicle (10) through powershift transmission. A hydraulic power supply (50) is provided on the upper structure (12) and the output of which is controlled by an operator in the excavator cab (32) to be supplied to the hydraulic motor (44) supported on the main chassis (26). The hydraulic motor (44) is connected to provide power input to the automatic transmission (34) for forward or reverse driving of the vehicle (10). Means are provided for selecting the gear ratio set in the powershift transmission (34) from the excavator cab (32). Hydraulic motor (44) drives a pump (68) which provides pressurized automatic transmission fluid for lubricating the powershift transmission (34) and provides power for operating selected clutches in the powershift transmission (34). An accumulator (66) provides pressurized hydraulic fluid when remote driving of the vehicle (10) is initiated for smooth engagement of the selected clutches in transmission (34).

9 Claims, 2 Drawing Figures

REMOTE DRIVE WITH POWERSHIFT TRANSMISSION

BACKGROUND OF THE INVENTION

1. Field of the Invention

This invention relates to driving a material handling vehicle and more particularly to remote driving of a vehicle from a cab on a movable upper structure thru a powershift transmission.

2. Description of the Prior Art

Frequently, a heavy duty material handling mechanism, such as a crane or excavator, is mounted from an upper structure supported by a lower or truck chassis. The truck chassis is capable of being driven over the road or highway under the control of an operator in the main truck cab. The material handling mechanism is supported on the upper structure which is mounted from a swing bearing for relative movement with respect to the supporting truck chassis. An operators cab is provided on the upper structure for operating the material handling mechanism. During operation at a construction site, an operator in the operators cab can control movement of the truck chassis. U.S. Pat. No. 3,599,814 teaches a remote drive mechanism for powering the drive wheels from an auxiliary engine mounted on the upper structure.

In an excavator as described in U.S. Pat. No. 3,599,814 the excavator is wheel mounted for mobility and has two engines, one on the truck chassis, primarily used for transporting the excavator between job sites, and one on the upper chassis, for powering the excavator functions. The chassis engine is turned off when the excavator is operating at a job site to conserve fuel and extend engine life. The auxiliary excavator engine is then utilized to supply hydraulic power to the excavator functions, and when the operator needs to move the vehicle this hydraulic power is delivered to the truck chassis and drives a hydraulic motor which is connected to the chassis drive system. A mechanical transmission operable from the truck chassis, is utilized for selecting the speed ratio at which the hydraulic motor can position the excavator. A limitation of this type remote drive is that an operator skilled in using a mechanical transmission is required and the gear ratio selection must be made before the operator leaves the truck chassis cab. Varying conditions on the job site may require an operator to go from the excavator cab to the truck cab to adjust the gear ratios. This results in lost time and productivity. Further a mechanical transmission allows only a limited speed in reverse gears.

DISCLOSURE OF THE INVENTION

The present invention teaches a remote drive which operates thru a powershift transmission, for driving a material handling vehicle from the upper structure or excavator cab. The disclosed control circuit allows the use of a powershift for driving the vehicle from the excavator cab. Use of the powershift transmission allows the machine to have high speed reverse capability and this is particularly desirable for a vehicle which travels on railroad tracks. The pressurized hydraulic fluid from the upper structure is used to operate a hydraulic motor for remote driving of the vehicle. A mechanical output of the hydraulic motor is connected to a power takeoff on the powershift transmission. The hydraulic motor also drives a pump which provides hydraulic fluid to the power transmission lubricating system and also to the transmission for operating the clutches in a selected gear range. The output of the powershift transmission is connected to the drive axles to which the driven wheels are attached. The direction in which the vehicle is moved is controlled by the direction of rotation of the hydraulic motor which is controlled from the excavator cab on the upper structure. Suitable controls can be provided for selecting various powershift transmission gear ratios from the upper structure.

The present remote drive system permits the use of an automatic or powershift transmission for driving the material handling vehicle. This eliminates the use of a clutch in the truck cab and lessens the down time due to machine abuse by the operator. Different gear ratios can also be selected from the excavator cab on the upper structure. This increases the operators control and permits faster adapting to changing job conditions. With the prior art mechanical or manual transmission only a limited speed in reverse gears was provided. In an application such as those requiring travel on railroad tracks a limited reverse speed can be very detrimental. In the disclosed vehicle utilizing the automatic transmission the same gear ratio can be provided for forward or reverse operation, and this permits a high speed reverse capability.

BRIEF DESCRIPTION OF DRAWINGS

For a better understanding of the invention reference may be had to the preferred embodiment exemplary of the invention, shown in the accompanying drawings in which.

BEST MODE FOR CARRYING OUT THE INVENTION

Figure 1:
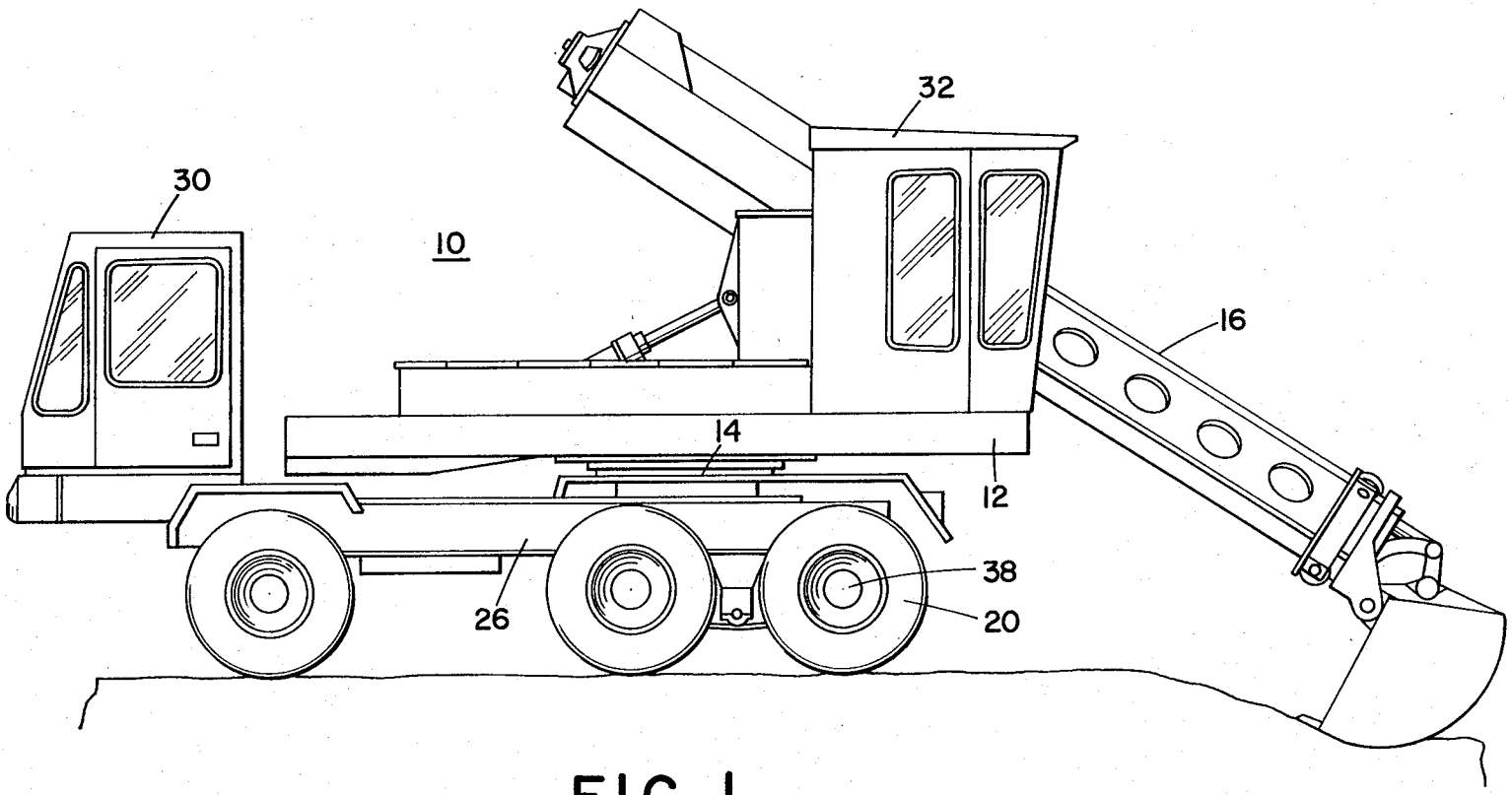
FIG. 1 is a side view of a truck mounted extendable boom hydraulic excavator on which the disclosed invention is utilized; and, FIG. 2 is a partial schematic of the hydraulic circuit, according to the teaching of the present invention, for driving the material handling vehicle from the upper structure.

Refer now to the drawings this is shown in FIG. 1 an excavating vehicle 10 having a boom 16 formed with a pair of telescopic sections. Boom 16 is pivotally mounted on an upper structure 12 which is rotatably supported by a swing bearing 14 from the main truck chassis. Vehicle 10 is provided with a forward or main truck cab 30 and a rearward or upper structure excavator or cab 32. Truch cab 30 is occupied by an operator during over the road movement to a selected site. Operator cab 32 is occupied by the operator during operation of the boom assembly which is mounted on upper support platform 12. The upper structure or excavator cab is utilized when driving the driven wheels 20 from the upper structure. The general construction of the material handling vehicle 10 is similar to that disclosed in U.S. Pat. Nos. 3,587,866; 3,599,814; and 3,666,125 from which a more detailed description of this type vehicle may be obtained. A main truck chassis engine 18 is mounted on the truck chassis 26 and through an automatic or powershift transmission 34, which is also mounted on truck chassis 26, drives driven wheels 20. An auxiliary or excavator engine 22 is mounted on the upper structure 12 and through the disclosed hydraulic circuit is also connected to automatic transmission 34 to drive driven wheels 20 in a forward or reverse direction. The use of the powershift transmission allows vehicle 10 to have a relatively high speed reverse capability. This is particularly useful on vehicles 10 equipped for railroad travel since it allows them to move quickly to and from the job site without requiring the rail riding vehicle to get off the tracks and turn around. An automatic transmission which has been found to be suitable for the disclosed application is the Clark 28410 series powershift transmission.

Figure 2:
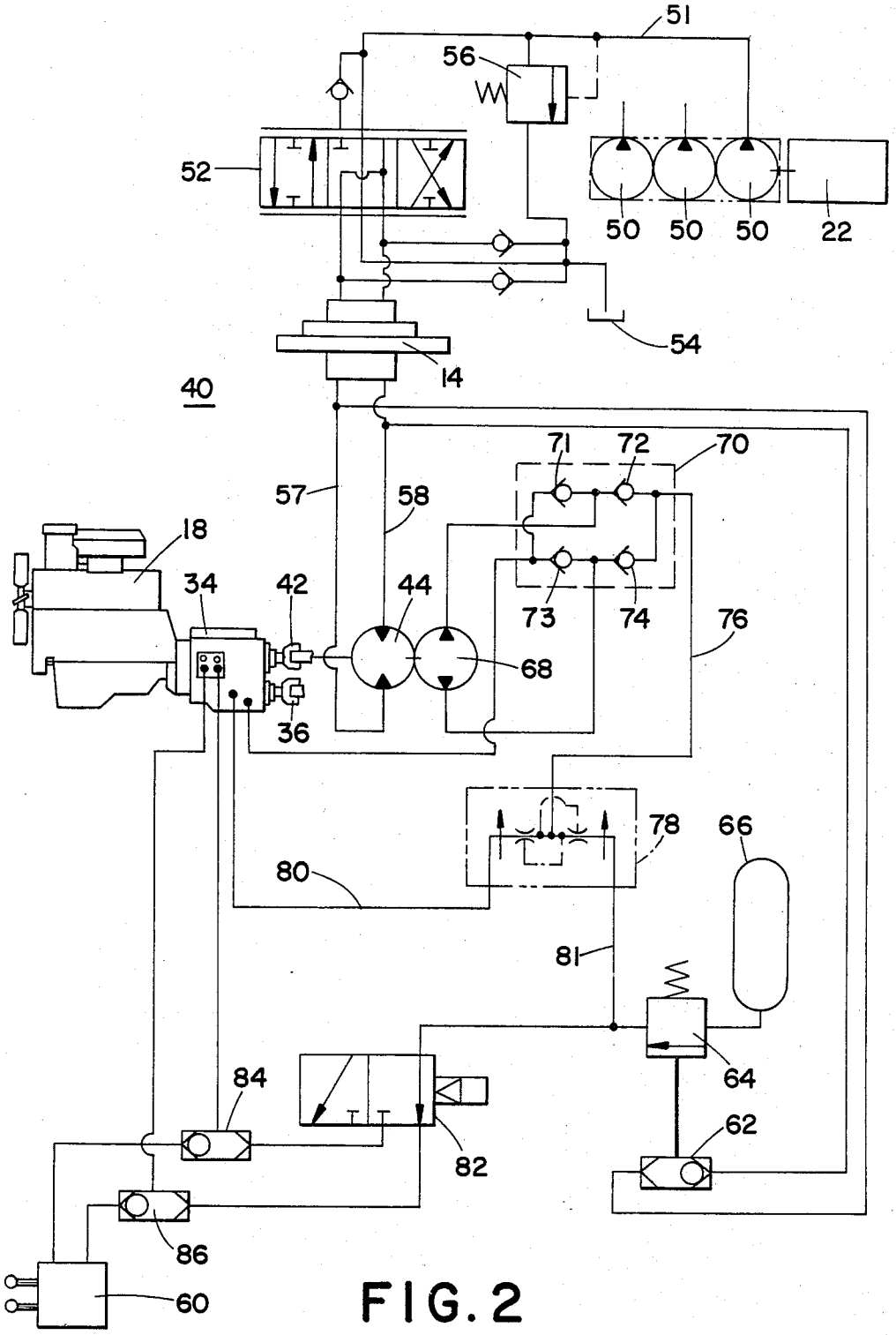

Referring now to FIG. 2 there as shown, a hydraulic circuit 40 which is used for driving vehicle 10 from upper structure 12. The powershift transmission 34 is connected by an integral torque converter to the carriers primary engine 18. The mechanical output of powershift transmission 34 is connected to a drive shaft 36 to supply power to axle 38 and driven wheels 20. Automatic transmission 34 also includes a power takeoff 42 which is connected to be driven by a hydraulic motor 44. Power for driving the hydraulic motor 44 to drive vehicle 10 from cab 32 is supplied from the upper structure 12. The auxiliary engine 22 mounted on upper structure 12 drives pumps 50. The pressurized hydraulic fluid output of one of the pumps 50 is supplied by hydraulic connection 51 to the direction control valve 52. Pumps 50 also have an input connection to the upper structure hydraulic sump 54.

A relief valve 56 connects line 51 to upper reservoir 54 to limit the pressure in hydraulic line 51. Direction control valve 52 is utilized to control the direction of rotation of hydraulic motor 44. Direction control valve 52 is a two way three position valve, shown in FIG. 2 in the center position wherein pressurized hydraulic fluid is not supplied to lines 57, 58 which extend through swing bearing 14. When direction control valve 52 is moved to one of its other positions, pressurized hydraulic fluid is supplied through hydraulic line 57 or 58 to supply pressurized hydraulic fluid to motor 44 to cause rotation in a desired direction. Hydraulic motor 44 connects to transmission 34 to provide power for remote driving of the vehicle 10.

Remote travel operation is performed by shutting off the truck carrier engine 18 and placing the transmission control valve 60, which is located in the truck cab 30, in a neutral position. When transmission control valve 60 is placed in neutral an operator in the upper structure excavator cab 32 can remotely drive vehicle 10. When the operator in the excavator cab 32 wishes to drive vehicle 10 he activates direction control valve 52 to supply pressurized hydraulic fluid to drive hydraulic motor 44 in a forward or reverse direction. When pressurized hydraulic fluid is supplied to either line 57 or 58 shuttle valve 62 is moved to a position to permit pressurized hydraulic fluid to open sequence valve 64. When sequence valve 64 is opened accumulator 66 supplies pressurized hydraulic fluid which is fed to transmission 34 to engage selected transmission clutches and provide smooth start-up of vehicle 10. As hydraulic drive motor 44 rotates to drive vehicle 10 it also operates pump 68. When pump 68 is turned it provides the pressurized automatic transmission fluid used by the transmission for lubrication, cooling and control.

Pressurized hydraulic fluid can be supplied from either port of pump 68 depending on the direction of rotation of hydraulic drive motor 44. A check block 70 consisting of four check valves 71, 72, 73 and 74 is provided to ensure that pressurized fluid is fed along line 76 regardless of the direction of rotation on pump 68. Pressurized hydraulic fluid from pump 68 is fed along line 76 to an adjustable flow divider 78.

Adjustable flow divider 78 divides the flow from pump 68 into two components, one of which is supplied to the lubrication system of the powershift transmission 34 and the other of which is used to control the transmission clutches. The flow from flow divider 78 along line 80 is to the transmission lubrication system. The flow in line 81 is to a remote gear selector valve 82. Gear selector valve 82 is used to select the gear ratio desired on transmission 34. While selector valve 82 is provided for selecting two gear ratios available on powershift transmission 34 additional valving and connectors can be supplied for selecting other gear ratios in transmission 34. Shuttle valves 84 and 86 are provided to inhibit fluid pressure from flowing to transmission control valve 60 when vehicle 10 is being driven from the excavator cab. When pressurized fluid is supplied from line 81 shuttle valve 86 is maintained in the position as shown in FIG. 2.

Flow to the selected transmission clutches for the desired gear ratio in transmission 34 is controlled by the remote gear selector valve 82. Selector valve 82 can be used to activate other clutches in transmission 34 when a different gear ratio is desired. The gear selection may be made for more power to climb grades or negotiate soft surfaces or for more speed in easy going situations. Remote gear selector valve 82 may be controlled in several ways such as, (1) manual control as with a cable or handle; (2) hydraulic power controlled from another controller; (3) electrically operated solenoid from a switch; (4) from a microprocessor which may be linked to load sensing devices to select the most efficient gear ratio; or (5) pneumatic pilot control. The gear ratio selected may be changed while vehicle 10 is moving.

Prior art material handling vehicles with a powershift transmission have not been provided with the remote travel control feature. One problem with direct driving of an automatic transmission with a hydraulic motor is clutches in the powershift transmission need hydraulic pressure to be engaged. Turning of the torque converter or integral transmission parts without operation of the pump 68 will cause damage to various transmission components. In operation of hydraulic circuit 40 the necessary pressurized fluid is supplied by pump 68 for lubrication and operation of the internal transmission clutches. When the speed ratio is selected in transmission 34 it is the same for either direction of rotation of pump 44. Thus vehicle 10 can be driven from the excavator cab 32 at the same speeds in either the forward or reverse direction.

We claim:

1. A material handling vehicle comprising:

a power driven chassis having a main cab;

an upper structure supported by said chassis and being moveable relative thereto having an operator cab;

the main drive engine supported on said power driven chassis;

a powershift transmission connected to be driven by said main engine having a power takeoff;

a swing bearing connecting said chassis and said upper structure;

an upper hydraulic power supply disposed on said upper structure providing an output of pressurized hydraulic fluid;

a hydraulic torque motor disposed on said chassis connected to be driven by pressurized hydraulic fluid supplied from said upper hydraulic power supply;

said hydraulic torque motor connected to provide power to the power takeoff connection on said powershift transmission and driving a hydraulic pump;

said hydraulic pump providing a pressurized output of hydraulic fluid and supplying said hydraulic fluid to the transmission lubrication system and the transmission gear range control clutches.

2. A material handling vehicle as claimed in claim 1 comprising:

a flow divider connected to divide the flow from the output of said hydraulic pump into a first component for lubricating transmissions and a second component for activating selected clutches in said transmission.

3. A material handling vehicle as claimed in claim 2 comprising:

a remote gear selector valve disposed in the clutch activation component from said divider operable to select different gear ratios in said powershift transmission.

4. A material handling vehicle as claimed in claim 1 comprising:

a direction control valve disposed on said upper chassis for controlling the direction of rotation of said hydraulic torque motor; and, a check block connected to said hydraulic pump for providing the pressurized hydraulic flow to said flow divider independent of the direction of rotation of said pump.

5. A material handling vehicle as claimed in Claim 1 comprising:

an accumulator connected to the clutch activation output line from said flow divider; and, a sequence valve activated when said hydraulic torque motor is activated to permit said accumulator to feed pressurized fluid into the line connected to activate the clutches in said powershift transmission.

6. An excavating vehicle comprising:

a main chassis supporting a main engine and being driven and steerable from a chassis cab;

an upper structure supported from said main chassis and being rotatable on a swing bearing connections thereto;

an excavator cab supported from said upper structure;

a powershift transmission having various gear ratios and being supported from said main chassis and being driven by said main engine and having a power takeoff;

a hydraulic motor supported on said main chassis being connected to the power takeoff on said powershift transmission;

hydraulic power supply means disposed on said upper structure and providing a pressurized hydraulic output;

control means responsive to an operator in said excavator cab for supplying the pressurized hydraulic output from said upper structure to said hydraulic motor for operating said hydraulic motor and remotely driving the excavator through said powershift transmission; and, pump means connected to be driven by said hydraulic motor and providing pressurized hydraulic fluid for providing lubrication for said powershift transmission and providing a pressurized source for selecting the desired gear ratio of said powershift transmission.

7. An excavating vehicle as claimed in claim 6 comprising:

means responsive to an operator in said excavator cab for providing different gear ratios on said powershift transmission.

8. A material handling vehicle comprising:

a drivable main chassis supported on wheels some of which are driven by a main engine through a powershift transmission;

a rotatable upper structure supported from said main chassis having an operators cab and a source of pressurized hydraulic fluid;

a hydraulic motor disposed on the main chassis having a connection to a power takeoff on said powershift transmission;

connecting means for connecting the source of pressurized hydraulic fluid on said upper structure to said hydraulic motor;

control means responsive to an operator in said upper structure cab for controlling connection of the source of pressurized hydraulic fluid to said hydraulic motor for remote driving of said driven wheels through said powershift transmission; and, pump means operable with said hydraulic motor for supplying hydraulic fluid to said powershift transmission gear range control clutches and to lubricate said powershift transmission.

9. A material handling vehicle as claimed in claim 8 comprising:

means responsive to an operator in the operators cab for selecting different gear ratios in said powershift transmission.

* * * * *

UNITED STATES PATENT AND TRADEMARK OFFICE

CERTIFICATE OF CORRECTION

PATENT NO. : 4,516,655

DATED : May 14, 1985

INVENTOR(S) : John M. Donahue and Michael J. Gagner

It is certified that error appears in the above—identified patent and that said Letters Patent is hereby corrected as shown below:

Col. 2, line 51, delete "truch" and substitute therefor --truck--.

Signed and Sealed this

*Tenth* Day of *September 1985*

[SEAL]

*Attest:*

DONALD J. QUIGG

*Attesting Officer* *Acting Commissioner of Patents and Trademarks - Designate*